US007114748B2

(12) United States Patent
Tsai et al.

(10) Patent No.: US 7,114,748 B2
(45) Date of Patent: Oct. 3, 2006

(54) SEATBELT-ADJUSTING DEVICE

(75) Inventors: Mei-Chao Tsai, Taipei (TW); Kuo-Wei Lee, Taipei (TW)

(73) Assignee: Wonderland Nurserygoods Co., Ltd., (TW)

( * ) Notice: Subject to any disclaimer, the term of this patent is extended or adjusted under 35 U.S.C. 154(b) by 317 days.

(21) Appl. No.: 10/678,974

(22) Filed: Oct. 3, 2003

(65) Prior Publication Data

US 2005/0073142 A1 Apr. 7, 2005

(51) Int. Cl.
*A62B 35/00* (2006.01)
*B60R 22/00* (2006.01)

(52) U.S. Cl. ..... 280/801.1; 297/468; 24/196

(58) Field of Classification Search ..... 280/801.1, 280/801.2, 808, 806; 24/171, 194, 196; 297/464, 297/468

See application file for complete search history.

(56) References Cited

U.S. PATENT DOCUMENTS 3,013,318 A * 12/1961 Davis ..... 24/196
3,226,786 A * 1/1966 Burdorf et al. ..... 24/171
3,975,800 A * 8/1976 Farlind ..... 24/196
4,848,794 A * 7/1989 Mader et al. ..... 280/801.1

* cited by examiner

*Primary Examiner*—Paul N. Dickson
*Assistant Examiner*—Leonard J. McCleary, Jr.
(74) *Attorney, Agent, or Firm*—Brinks Hofer Gilson & Lione

(57) ABSTRACT

A seatbelt-adjusting device includes a belt-holding piece that is mounted slidably on a frame unit, and that is slidable on the frame unit between front and rear positions. A positioning member has left and right end portions and a bridge portion interconnecting the left and right end portions. The left and right end portions of the positioning member are respectively pivoted to left and right sides of the frame unit so as to be pivotable between a first position, in which, the bridge portion of the positioning member is spaced apart from the belt-holding piece, and a second position, in which, the bridge portion of the positioning member abuts against the belt-holding piece when the belt-holding piece is disposed at the front position.

3 Claims, 5 Drawing Sheets

SEATBELT-ADJUSTING DEVICE

BACKGROUND OF THE INVENTION

1. Field of the Invention

The present invention relates to a seatbelt-adjusting device that is adapted to be easily operated and that is adapted to firmly retain a belt thereon.

2. Description of the Related Art

Referring to FIGS. 1 and 2, a conventional seatbelt-adjusting device 100 is shown to include a base member 10, an elongated belt-holding piece 12, a positioning member 14, and a seatbelt 18.

As illustrated, the base member 10 has top and bottom surfaces, and left and right sides extending from the top surface to the bottom surface, and defines an opening 101 that extends between the left and right sides and that has left and right ends disposed respectively adjacent to the left and right sides of the base member 10, and front and rear ends.

The elongated belt-holding piece 12 is mounted slidably on the top surface of the base member 10, spans the left and right ends of the opening 101, and is slidable on the top surface of the base member 10 between a rear position, in which, the belt-holding piece 12 is disposed adjacent to the rear end of the opening 101, as best shown in FIG. 1, and a front position, in which, the belt-holding piece 12 is disposed adjacent to the front end of the opening 101, as shown in FIG. 2.

The seatbelt 18 has a looped portion inserted from the bottom surface of the base member 10 into the opening 101, and is sleeved on the belt-holding piece 12.

The positioning member 14 is mounted rotatably on the base member 10, is rotatable about a vertical axis perpendicular to the top surface of the base member 10 between a first position, in which, the positioning member 14 is spaced apart from the seatbelt-holding piece 12, as shown in FIG. 1, so as to permit adjustment of the seatbelt 18 thereon, and a second position, in which, the positioning member 14 abuts against the seatbelt 18 and the seatbelt-holding piece 12, as best shown in FIG. 2, when the seatbelt-holding piece 12 is moved to the front position.

One disadvantage of the aforesaid conventional seatbelt-adjusting device resides in that the seatbelt-holding piece 12 together with the belt 18 is not firmly retained by the positioning member 14 since the abutting area of the positioning member 14 relative to the seatbelt-holding piece 12 is relatively small.

SUMMARY OF THE INVENTION

Therefore, the object of this invention is to provide a seatbelt-adjusting device that is adapted to firmly retain a belt-holding piece together with a belt on a frame unit so as to overcome the aforesaid disadvantage of the prior art.

According to the present invention, the seatbelt-adjusting device includes: a frame unit having top and bottom surfaces, and left and right sides that extend from the top surface to the bottom surface, and defining an opening that extends between the left and right sides and that has left and right ends disposed respectively adjacent to the left and right sides of the frame unit, and front and rear ends; an elongated belt-holding piece mounted slidably on the top surface of the frame unit, spanning the left and right ends of the opening, and slidable on the top surface of the frame unit between a rear position, in which, the belt-holding piece is disposed adjacent to the rear end of the opening, and a front position, in which, the belt-holding piece is disposed adjacent to the front end of the opening; and a positioning member disposed rearwardly of the belt-holding piece, and having left and right end portions and a bridge portion extending between and interconnecting the left and right end portions. The left and right end portions of the positioning member are respectively pivoted to the left and right sides of the frame unit so as to be pivotable about a rotating axis parallel to the top surface of the frame unit between a first position, in which, the bridge portion of the positioning member is spaced apart from the said belt-holding piece, and a second position, in which, the bridge portion of the positioning member abuts against the belt-holding piece when the belt-holding piece is disposed at the front position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
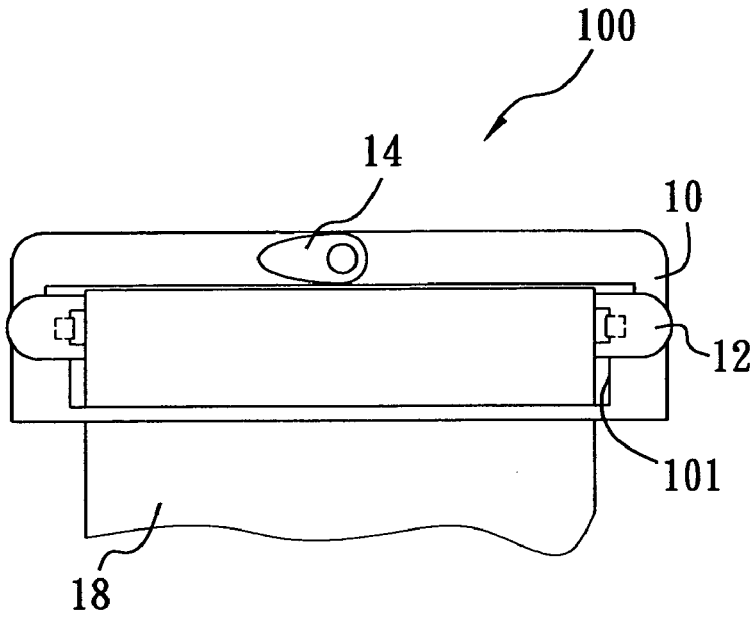
F I G. 1 PRIOR ART
FIG. 1 is a schematic top view illustrating a belt-holding piece of a conventional seatbelt-adjusting device at an adjustable position.
Figure 2:
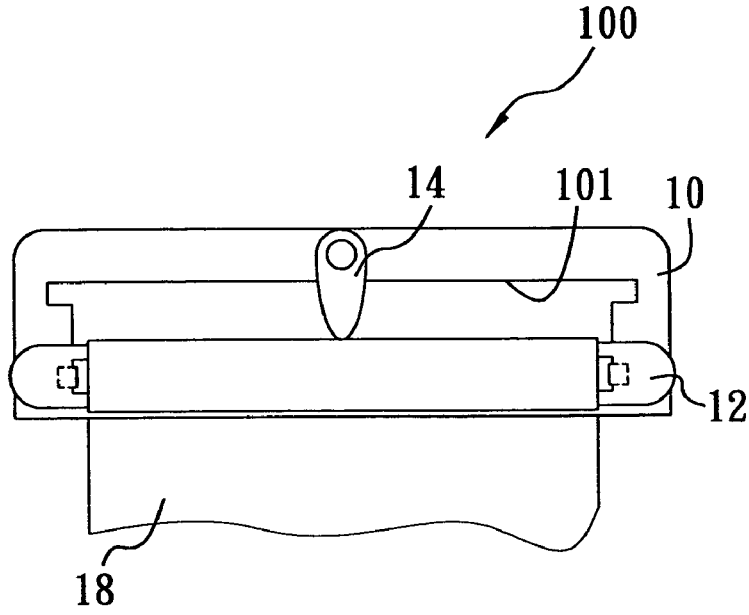
F I G. 2 PRIOR ART
FIG. 2 is a schematic top view illustrating the belt-holding piece of the conventional seatbelt-adjusting device at a non-adjustable position.
Figure 3:
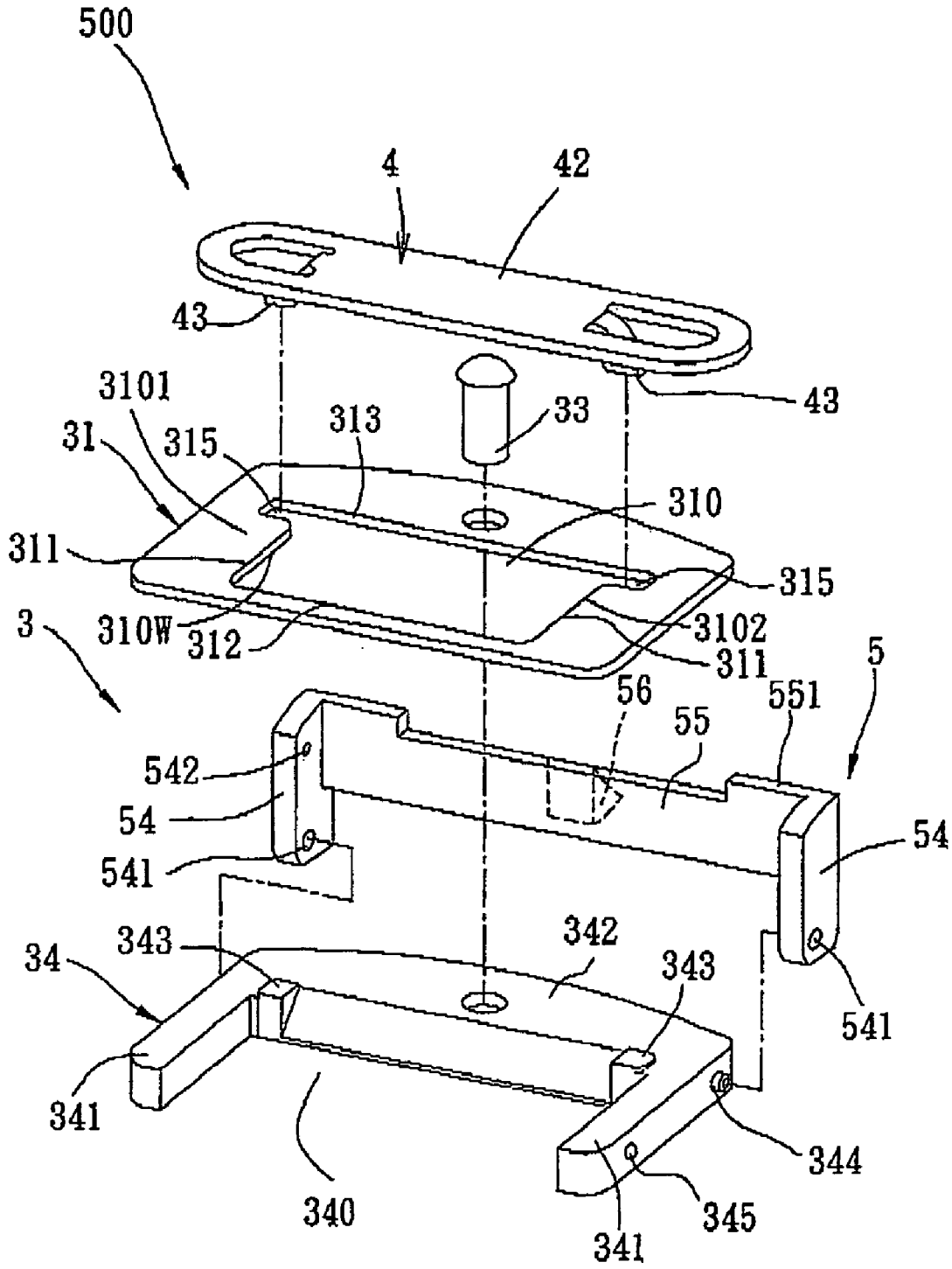
FIG. 3 is an exploded perspective view of the preferred embodiment of a seatbelt-adjusting device according to the present invention.
Figure 4:
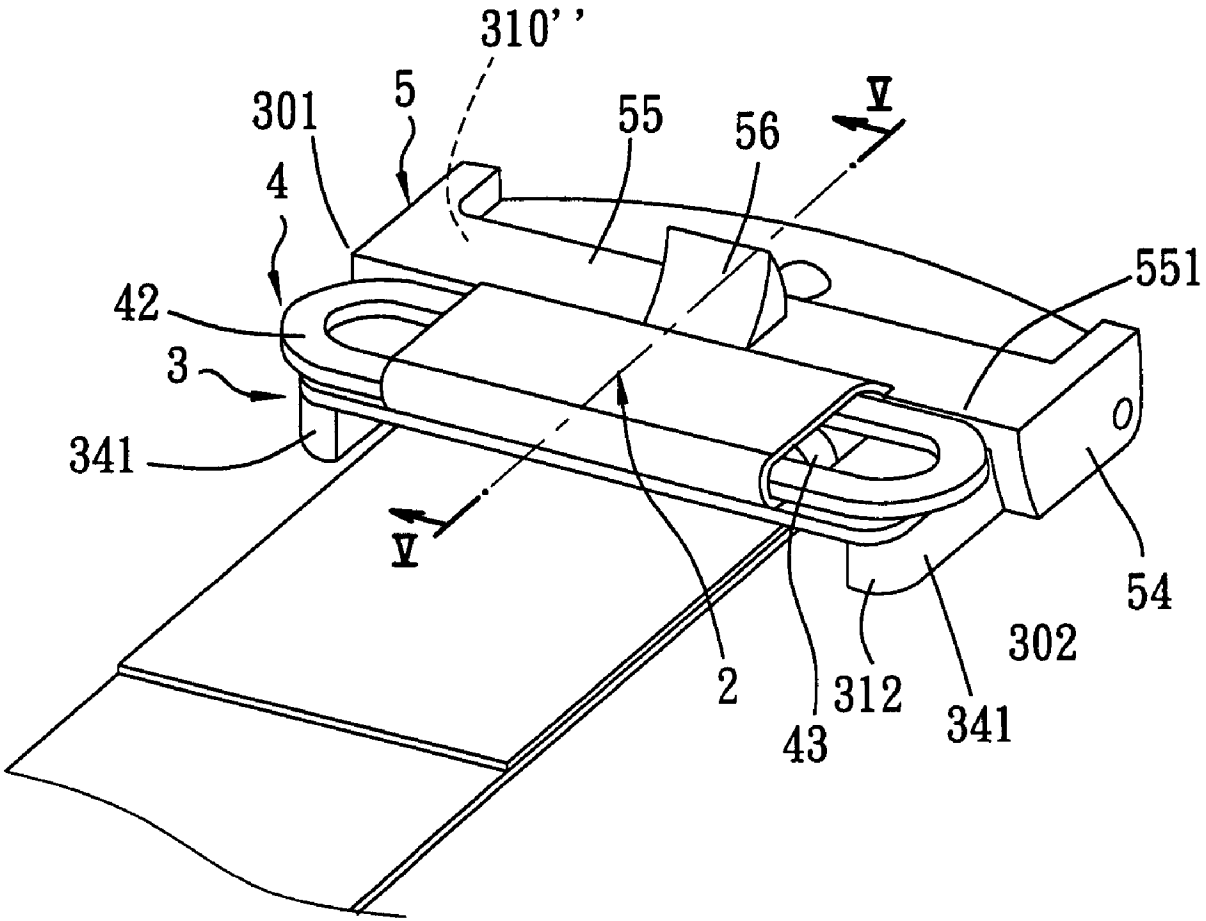
FIG. 4 is an assembled, perspective view of the preferred embodiment, illustrating how a belt-holding piece is secured relative to a frame unit.

Referring to FIGS. 3 and 4, the preferred embodiment of a seatbelt-adjusting device 500 according to the present invention is shown to include a frame unit 3, an elongated belt-holding piece 4, a positioning member 5, and a seatbelt 2.

As illustrated, the frame unit 3 has top and bottom surfaces, and left and right sides 301,302 extending from the top surface to the bottom surface, and defines an opening 310" that extends between the left and right sides 301,302 and that has left and right ends 3101,3102 disposed respectively adjacent to the left and right sides 301,302 of the frame unit 3, and front and rear ends 312,313.

Figure 6:
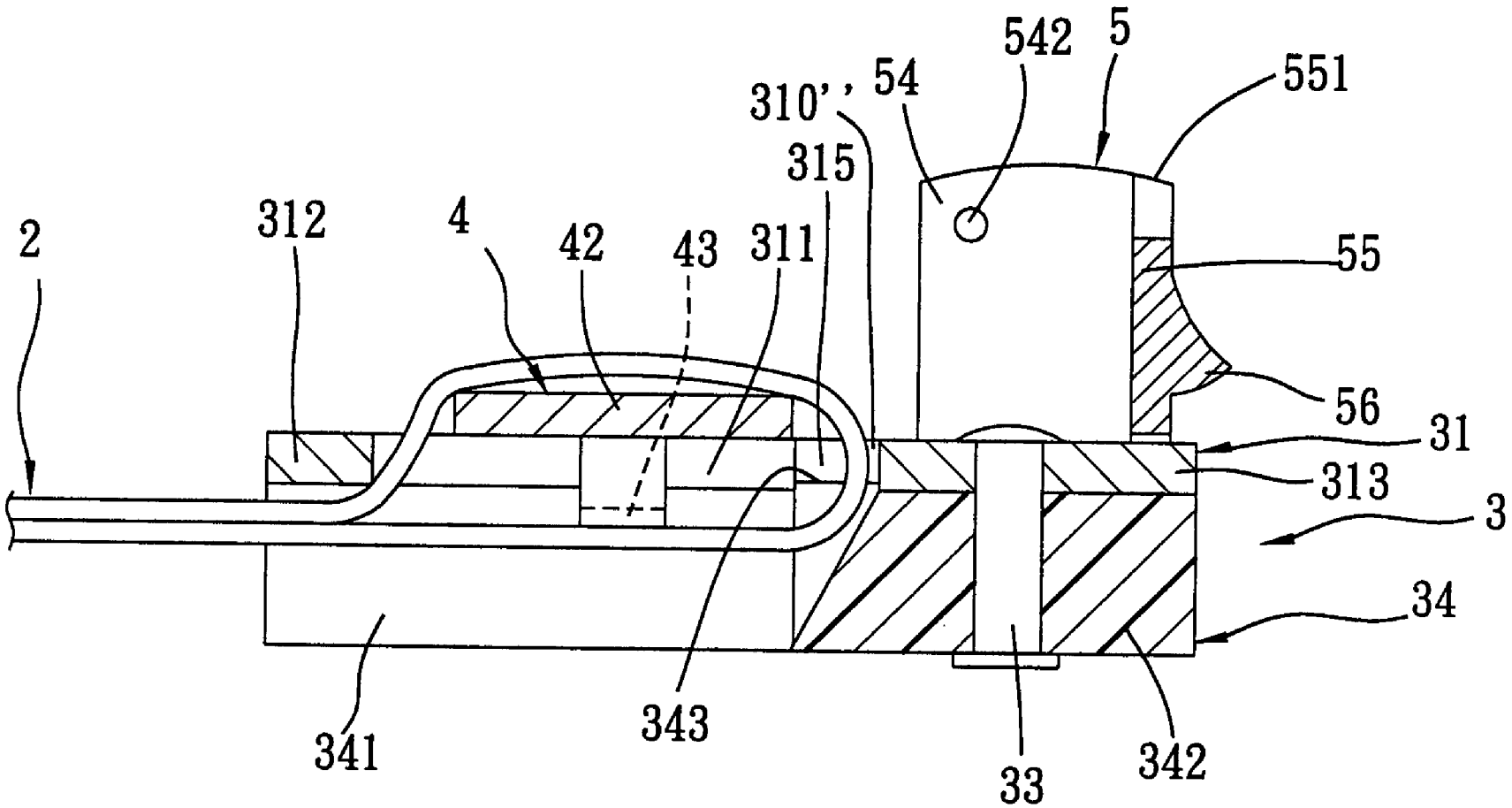
FIG. 6 is a cross sectional view of the preferred embodiment, illustrating how the belt-holding piece is retained slidably on the frame unit.

The elongated belt-holding piece 4 is mounted slidably on the top surface of the frame unit 3, spans the left and right ends 3101,3102 of the opening 310", and is slidable on the top surface of the frame unit 3 between a rear position, in which, the belt-holding piece 4 is disposed adjacent to the rear end 313 of the opening 310", as best shown in FIG. 6, and a front position, in which, the belt-holding piece 4 is disposed adjacent to the front end 312 of the opening 310", as best shown in FIG. 4.

The seatbelt 2 has a looped portion inserted from the bottom surface of the frame unit 3 into the opening 310" in the frame unit 3 so as to be sleeved around the belt-holding piece 4.

Figure 5:
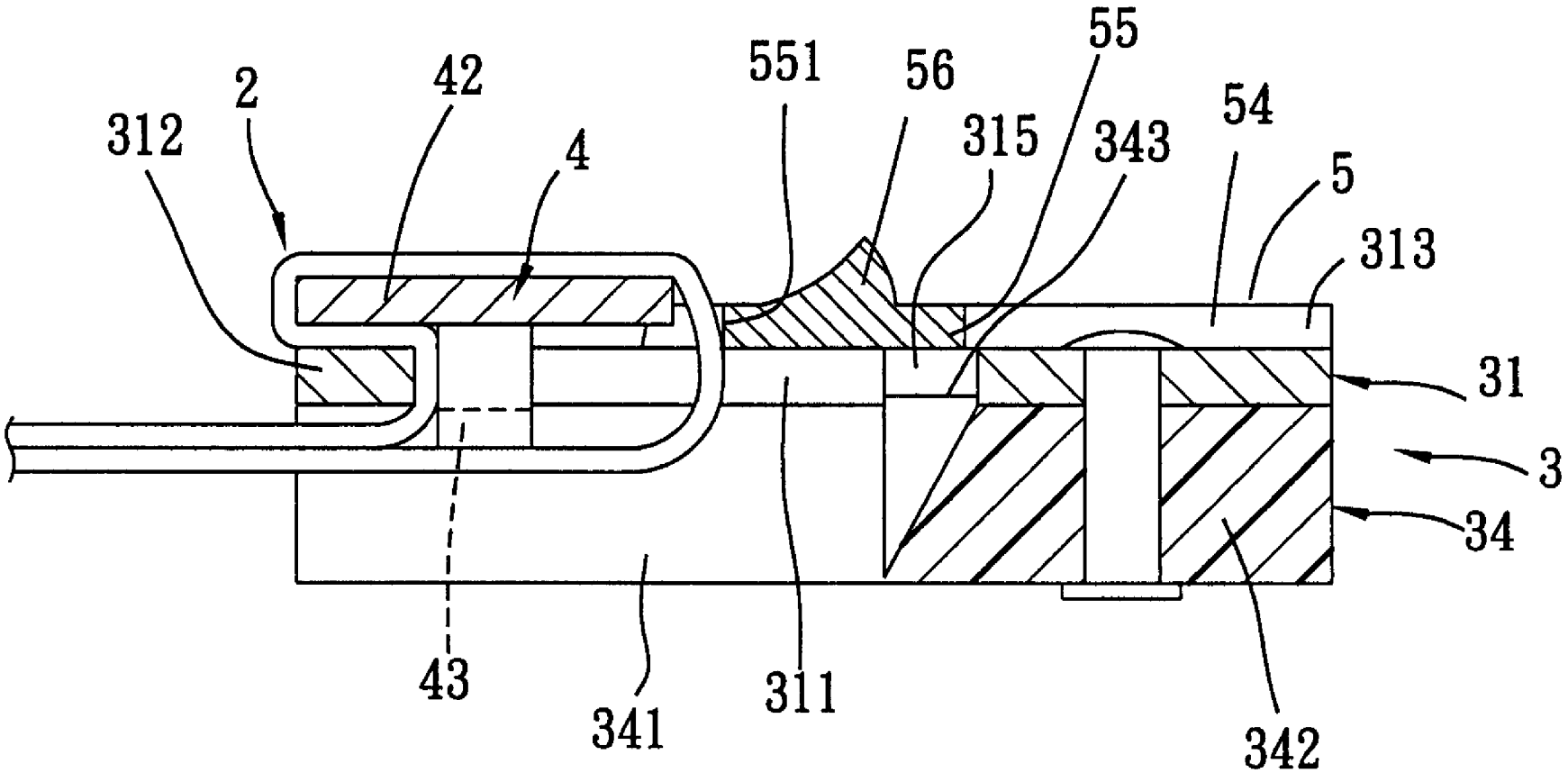
FIG. 5 is a cross sectional view of the preferred embodiment taken along lines V—V of FIG. 4.

The positioning member 5 is disposed rearwardly of the belt-holding piece 4, and has left and right end portions 54 and a bridge portion 55 extending between and interconnecting the left and right end portions 54. The left and right end portions 54 of the positioning member 5 are respectively pivoted to the left and right sides 301,302 of the frame unit 3 so as to be pivotable about a rotating axis 344 parallel to the top surface of the frame unit 3 between a first position, in which, the bridge portion 55 of the positioning member 5 is spaced apart from the belt-holding piece 4, as best shown in FIG. 6, and in which, adjustment of the seatbelt 2 can be conducted, and a second position, in which, an abutting face 551 of the bridge portion 55 of the positioning member 5 abuts against the belt-holding piece 4 and the seatbelt 2, when the belt-holding piece 4 is disposed at the front position, as best shown in FIG. 5. At this time, adjustment of the seatbelt 2 cannot be conducted.

In the preferred embodiment, the frame unit 3 includes a U-shaped base member 34, a mounting frame 31, and a rivet 33. The base member 34 has a rear portion 342 and left and right portions 341 extending frontwardly and respectively from two opposite ends of the rear portion 342 to serve as the left and right sides 301,302 of the frame unit 3, respectively. The rear, left and right portions 342,341 define a recess 340 thereamong. The mounting frame 31 is fixed on the base member 34 via the rivet 33, and is formed with a through-hole 310 that is registered with the recess 340 in the base member 34. Under this condition, the through-hole 310 in the mounting frame 31 defines the opening 310" in the frame unit 3. The through-hole 310 in the mounting frame 31 is confined by a hole-defining wall 310W (see FIG. 3), has a large-width portion 315 adjacent to the rear portion 342 of the base member 34, and a small-width portion 311 with a width smaller than that of the large-width portion 315. The belt-holding piece 4 includes a sliding block 42 disposed slidably on the mounting frame 31 and spanning the through-hole 310, and two engaging legs 43 diverging downwardly from the sliding block 42, and extending through the through-hole 310 in the mounting frame 31 and into the recess 340 in the base member 34. The engaging legs 43 respectively have free ends that are spaced apart from each other by a width which is smaller than that of the large-width portion 315 of the through-hole 310 so as to permit mounting or removal of the belt-holding piece 4 from the mounting frame 31, and greater than that of the small-width portion 311 of the through-hole 310 so as to permit retaining of the belt-holding piece 4 on the mounting frame 31 when the belt-holding piece 4 extends into the small-width portion 311 of the through-hole 310.

The base member 34 further has spaced apart stop elements 343 projecting from the rear portion 342 into the large-width portion 315 of the through-hole 310 in the mounting frame 31 to block respectively the engaging legs 43 of the sliding block 42 from entering into the large-width portion 315 when the sliding block 42 is moved to the rear position so as to prevent untimely and undesired removal of the sliding block 42 from the mounting frame 31. The base member 34 is further formed with two pivots 344" which project oppositely and respectively from the left and right portions 341 of the base member 34 into two pivot holes 541 in the left and right end portions 54 of the positioning member 5 and which cooperatively define the rotating axis 344 of the positioning member 5.

Preferably, the left and right end portions 54 of the positioning member 5 are formed with engaging grooves 542, respectively. The left and right portions 341 of the base member 34 are formed with engaging bosses 345 that respectively engage the engaging grooves 542 in the left and right end portions 54 of the positioning member 5, thereby enhancing positioning of the sliding block 42 at the front position when the positioning member 5 is disposed at the second position. The bridge portion 55 of the positioning member 5 is provided with a push tab 56 to facilitate turning of the same between the first and second positions.

Since the entire length of the bridge portion 55 of the positioning member 5 abuts against the belt-holding piece 4, the latter is retained securely when disposed at the front position. The object of the present invention is thus met.

With this invention thus explained, it is apparent that numerous modifications and variations can be made without departing from the scope and spirit of this invention. It is therefore intended that the invention be limited only as indicated in the appended claims.

We claim:

1. A seatbelt-adjusting device comprising:

a frame unit having top and bottom surfaces, and left and right sides that extend from said top surface to said bottom surface, and defining an opening that extends between said left and right sides and that has left and right ends disposed respectively adjacent to said left and right sides of said frame unit, and front and rear ends;

an elongated belt-holding piece mounted slidably on said top surface of said frame unit, spanning said left and right ends of said opening, and slidable on said top surface of said frame unit between a rear position, in which, said belt-holding piece is disposed adjacent to said rear end of said opening, and a front position, in which, said belt-holding piece is disposed adjacent to said front end of said opening; and a positioning member disposed rearwardly of said belt-holding piece, and having left and right end portions and a bridge portion extending between and interconnecting said left and right end portions, said left and right end portions of said positioning member being respectively pivoted to said left and right sides of said frame unit so as to be pivotable about a rotating axis parallel to said top surface of said frame unit between a first position, in which, said bridge portion of said positioning member is spaced apart from said belt-holding piece, and a second position, in which, said bridge portion of said positioning member abuts against said belt-holding piece when said belt-holding piece is disposed at said front position;

wherein said frame unit includes a U-shaped base member having a rear portion and left and right portions extending frontwardly and respectively from two opposite ends of said rear portion to serve respectively as said left and right sides of said frame unit, said rear, left and right portions defining a recess thereamong, said frame unit further including a mounting frame fixed on said base member and formed with a through-hole that is registered with said recess in said base member so as to define said opening in said frame unit, said through-hole in said mounting frame being confined by an opening-defining wall having a large-width portion adjacent to said rear portion of said base member and a small-width portion with a width smaller than that of said large-width portion, said belt-holding piece including a sliding block disposed slidably on said mounting frame and spanning said through-hole, and two engaging legs extending downwardly from said sliding block, through said through-hole in said mounting frame and into said recess in said base member.

2. The seatbelt-adjusting device as defined in claim 1, wherein said engaging legs respectively have free ends that are spaced apart from each other by a width which is smaller than that of said large-width portion of said through-hole so as to permit mounting or removal of said belt-holding piece from said mounting frame and greater than that of said small-width portion of said through-hole so as to permit retaining of said belt-holding piece on said mounting frame when said belt-holding piece extends into said small-width portion of said through-hole, said base member further having spaced apart stop elements projecting from said rear portion into said large-width portion of said through-hole in said mounting frame to block respectively said engaging legs of said sliding block from entering into said large-width portion when said sliding block is moved to said rear position so as to prevent untimely and undesired removal of said sliding block from said mounting frame.

3. The seatbelt-adjusting device as defined in claim 2, wherein said left and right end portions of said positioning member are respectively formed with engaging grooves, said left and right portions of said base member being respectively formed with engaging bosses that respectively engage said engaging grooves of said left and right end portions of said positioning member, thereby enhancing positioning of said sliding block at said front position when said positioning member is disposed at said second position.

* * * * *